US009545534B2

(12) United States Patent
Crandall

(10) Patent No.: US 9,545,534 B2
(45) Date of Patent: Jan. 17, 2017

(54) APPARATUS FOR USING A MEDICINE BALL

(71) Applicant: Brandon Crandall, Kirksville, MO (US)

(72) Inventor: Brandon Crandall, Kirksville, MO (US)

( * ) Notice: Subject to any disclaimer, the term of this patent is extended or adjusted under 35 U.S.C. 154(b) by 0 days.

(21) Appl. No.: 14/700,948

(22) Filed: Apr. 30, 2015

(65) Prior Publication Data

US 2015/0314156 A1 Nov. 5, 2015

Related U.S. Application Data

(60) Provisional application No. 61/986,358, filed on Apr. 30, 2014.

(51) Int. Cl.

| | |
|---|---|
| ***A63B 21/06*** | (2006.01) |
| ***A63B 21/00*** | (2006.01) |
| ***A63B 21/065*** | (2006.01) |
| ***A63B 23/035*** | (2006.01) |
| ***A63B 21/055*** | (2006.01) |
| ***A63B 21/068*** | (2006.01) |
| ***A63B 21/072*** | (2006.01) |

(52) U.S. Cl.

CPC ..... *A63B 21/00043* (2013.01); *A63B 21/0004* (2013.01); *A63B 21/00072* (2013.01); *A63B 21/00185* (2013.01); *A63B 21/0555* (2013.01); *A63B 21/0601* (2013.01); *A63B 21/065* (2013.01); *A63B 21/068* (2013.01); *A63B 21/072* (2013.01); *A63B 21/4011* (2015.10); *A63B 21/4015* (2015.10); *A63B 21/4019* (2015.10); *A63B 23/03525* (2013.01); *A63B 23/03558* (2013.01)

(58) Field of Classification Search

CPC ..... A63B 21/0004; A63B 21/065; A63B 21/0601; A63B 21/06; A63B 21/0603; A63B 21/0604; A63B 21/0607; A63B 43/00; A63B 43/007; A63B 43/02; A63B 37/12; A63B 37/14; A63B 47/00; A63B 47/001; A63B 47/007; A63B 47/02; A63B 57/20; A63B 21/4013; A63B 21/4015; A63B 21/4025; A63B 23/04; Y10T 24/4093; A44B 11/04

USPC ..... 473/212–217, 450, 458, 423–430, 464

See application file for complete search history.

(56) References Cited

U.S. PATENT DOCUMENTS 244,776 A * 7/1881 Wales ..... A41F 3/00 2/336

287,818 A * 11/1883 Freeman ..... A41F 3/00 2/332

(Continued)

*Primary Examiner* — Loan H Thanh

*Assistant Examiner* — Megan Anderson

(74) *Attorney, Agent, or Firm* — Senniger Powers LLP

(57) ABSTRACT

An apparatus for holding a medicine ball includes an adjustable holder for receiving medicine balls of different sizes and a pair of adjustable straps for securing the holder to different portions of a user's body. In some embodiments, the holder comprises adjustable bands, the length of which can be adjusted to adjust the size of the holder. The bands define a holder interior for receiving the medicine balls. The apparatus can include first and second adjustment plates positioned at opposite ends of the holder to secure the holder to the two straps. Each adjustable strap loops through slots in the plate and fastens to itself to secure the holder to a body portion. Bands of the holder can loop through slots in the plate and fasten to themselves to secure the holder around a medicine ball.

12 Claims, 7 Drawing Sheets

(56) References Cited

U.S. PATENT DOCUMENTS

| | | | | | |
|---|---|---|---|---|---|
| 862,957 | A * | 8/1907 | Armat | A44B 11/04 | 2/316 |
| 4,510,982 | A * | 4/1985 | Sangroni | A63B 47/001 | 190/108 |
| 5,238,162 | A * | 8/1993 | LaCivita | A45F 3/14 | 206/315.9 |
| 6,412,150 | B1 * | 7/2002 | Monderine | A44B 11/02 | 24/200 |
| 6,475,125 | B1 * | 11/2002 | Roberts | A63B 43/007 | 482/121 |
| 6,692,420 | B2 * | 2/2004 | Walden | A63B 67/10 | 273/DIG. 19 |
| 8,882,642 | B2 * | 11/2014 | Chavez | A63B 21/0442 | 482/121 |
| 2007/0066457 | A1 * | 3/2007 | Abranchess | A63B 21/4007 | 482/121 |
| 2007/0265151 | A1 * | 11/2007 | Ballard Olson | A63B 47/00 | 482/148 |

* cited by examiner

APPARATUS FOR USING A MEDICINE BALL

FIELD

The present invention generally relates to exercise equipment, and more particularly, to an apparatus for use in combination with a medicine ball for exercise.

BACKGROUND

Weighted exercise balls, or "medicine balls," are frequently used for rehabilitation and strength training. Because medicine balls are round, they are difficult to grasp with any portion of a user's body other than the hands. As a result, the applications for medicine balls in rehabilitation and strengthening are somewhat limited. An apparatus for securing a medicine ball to a portion of a user's body is desired.

SUMMARY

In one aspect, an apparatus for use in combination with a medicine ball having a predetermined size comprises a holder having an interior sized and shaped for holding the medicine ball. An adjustable strap is attached to the holder for receiving a portion of a user's body during exercise.

In another aspect an apparatus for use in combination with a medicine ball having a predetermined size comprises two opposing plates and two adjustable straps. At least four bands extend between said plates forming an interior sized and shaped for holding the medicine ball. Each of the two adjustable straps extend from one of said opposing plates in a direction away from said interior for receiving a portion of a user's body during exercise.

In another aspect, an apparatus for use in combination with a medicine ball having a predetermined size comprises a holder having an interior sized and shaped for holding the medicine ball and a pair of adjustable straps. Each strap of said pair is attached to opposite sides of the holder for receiving a portion of a user's body during exercise.

Other aspects and features will be apparent in view of the drawings, description, and claims.

BRIEF DESCRIPTION OF THE DRAWINGS

Corresponding reference characters indicate corresponding parts throughout the drawings.

DETAILED DESCRIPTION

Figure 1:
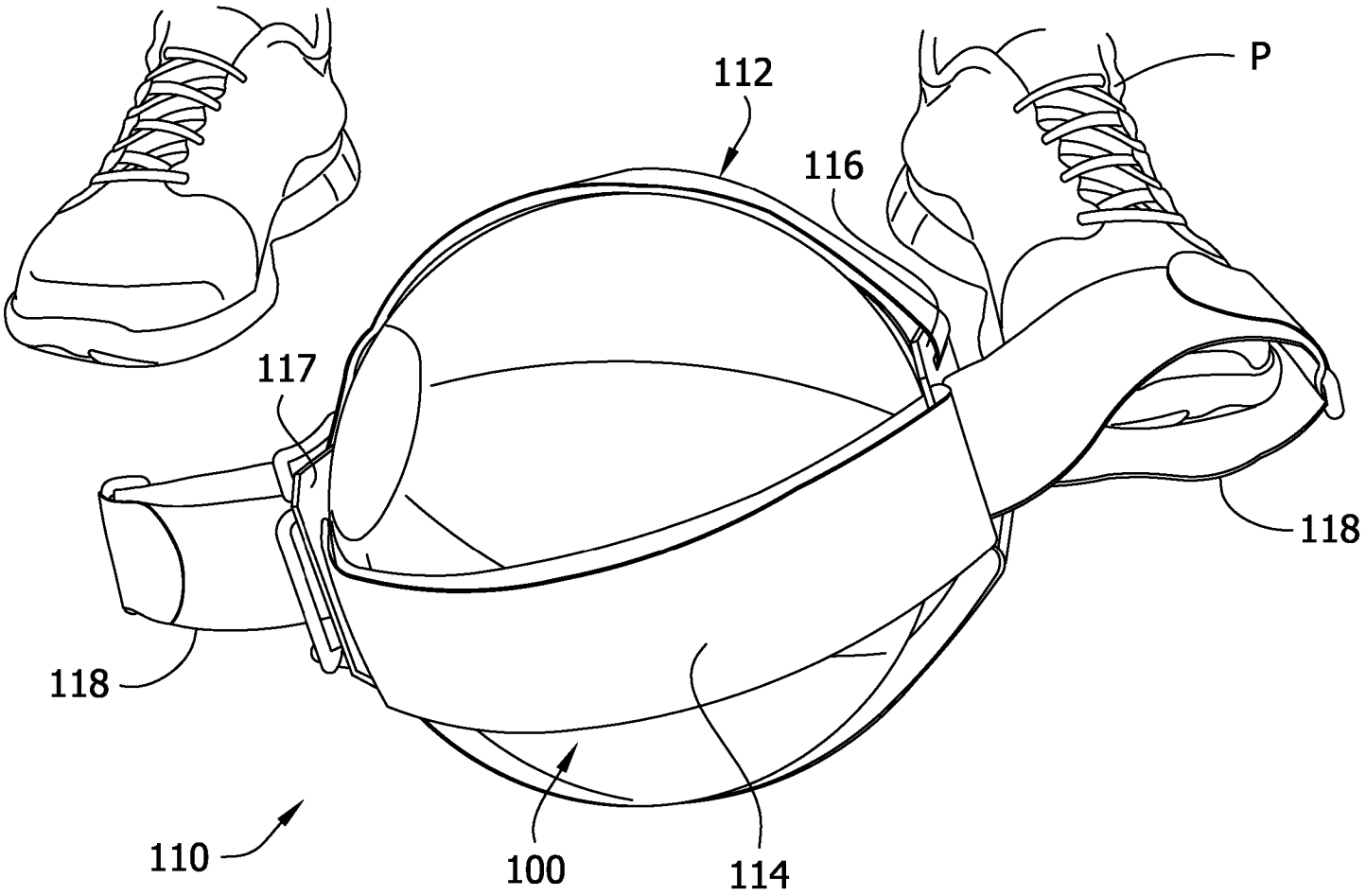
FIG. 1 is a perspective of a sling secured to a medicine ball with a portion of a user's body secured to the sling.

Referring to the drawings and particularly to FIG. 1, a sling (broadly, an "apparatus") for holding a weighted exercise ball 100 (a "medicine ball") is generally indicated at reference number 110. The sling 110 includes a holder 112 comprising four bands 114 for securing the sling around medicine balls 100 of varying sizes. First and second adjustment plates 116, 117 connect the holder 112 to a pair of straps 118 for securing the sling 110 and medicine ball 100 to portions P of a user's body. As will be appreciated, the sling 110 permits a user to securely attach medicine balls 100 of varying sizes to the user's feet, legs, hands, arms, etc. to use the weight of the medicine ball in various types of exercises.

Each adjustment plate 116, 117 is configured to connect the holder 112 to a respective one of the straps 118 and to permit lengthwise adjustment of the strap and the bands 114. In the illustrated embodiment, each of the plates 116, 117 is substantially identical. Reference will now be made specifically to the first adjustment plate 116 with the understanding that the second adjustment plate 117 has a substantially identical construction. Though the sling 110 has first and second adjustment plates 116, 117 of substantially identical constructions it will be understood that the plates could be constructed differently from one another without departing from the scope of the invention.

Figure 2:
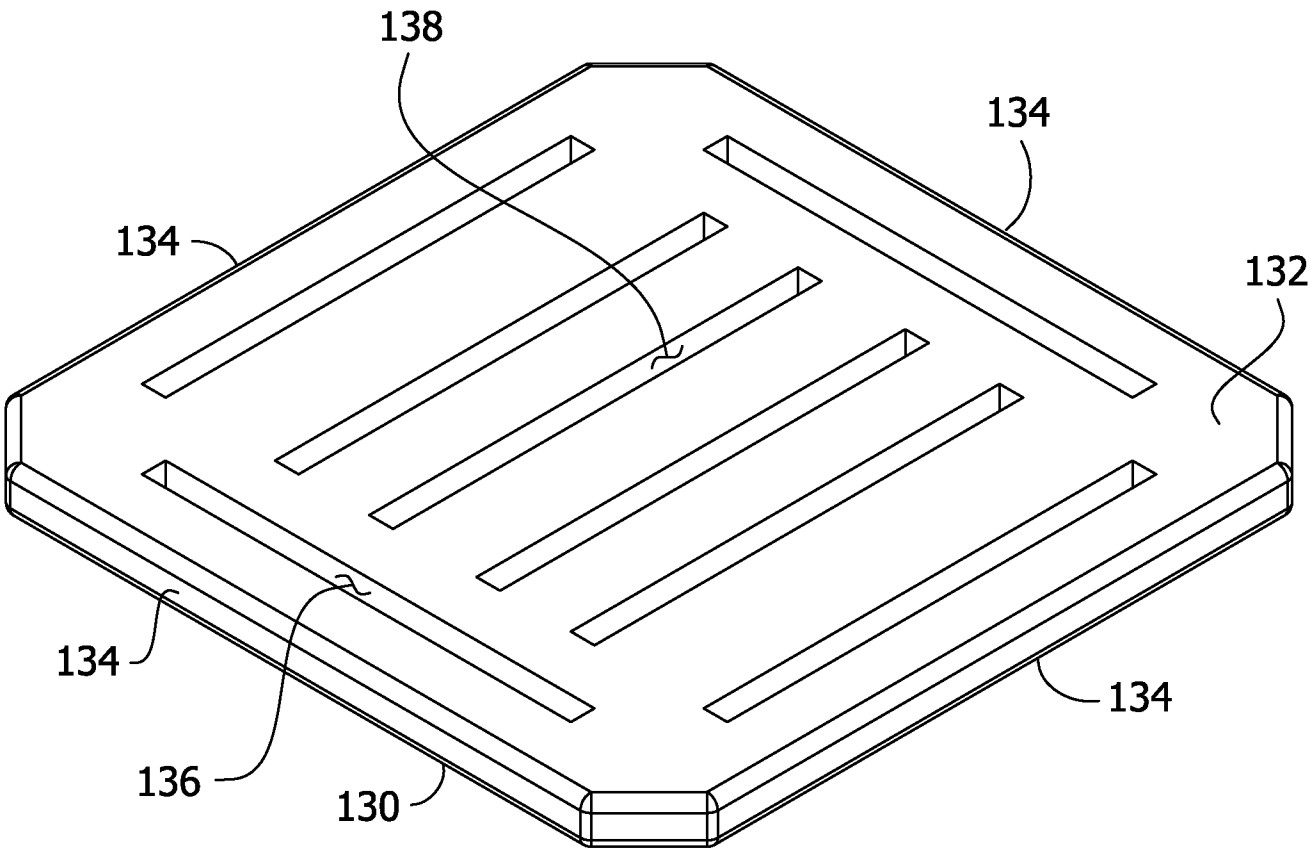
FIG. 2 is a perspective of an adjustment plate of the sling.

Referring to FIG. 2, in a preferred embodiment, the plate 116 comprises a rigid plastic material. But other materials may also be used without departing from the scope of the invention. The plate 116 has an inner surface 130, an outer surface 132 opposite the inner surface, and a thickness extending between the inner and outer surfaces. The illustrated plate 116 is substantially square-shaped and has four sides 134. It will be understood that plates of other shapes may also be used without departing from the scope of the invention. Four elongate perimeter slots 136 positioned adjacent each of the sides 134 extend through the thickness of the plate 116 from the inner surface 130 through the outer surface 132. Each perimeter slot 136 extends substantially parallel to an adjacent side 134 of the plate 116. Each perimeter slot 136 is sized to receive a respective one of the bands 114 therethrough and thereby secure the respective band to the plate 116. The plate 116 also includes four elongate central slots 138 that extend through the thickness of the plate from the inner surface 130 through the outer surface 132. The central slots 138 are oriented parallel to one another. The central slots 138 are each sized to receive a respective one of the straps 118 therethrough and thereby secure the respective strap to the plate 116.

Although the illustrated sling 110 uses two rigid plates 116, 117 to retain adjustable bands 114 in the shape of a holder 112 and to secure adjustable straps 118 to the holder, it will be understood that other slings could be constructed without rigid plates. For example, fabric materials could be substituted for the plates 116, 117 without departing from the scope of the invention. In one or more embodiments, a medicine ball holder comprises adjustable bands 114 that are sewn directly to an adjustable strap. In other embodiments, the bands and straps are sewn to separate pieces of fabric positioned between the bands and the straps as the plates 116, 117 are positioned in the sling 110. In still other embodiments, the adjustable bands and straps are connected to one another in other ways.

Figure 3:
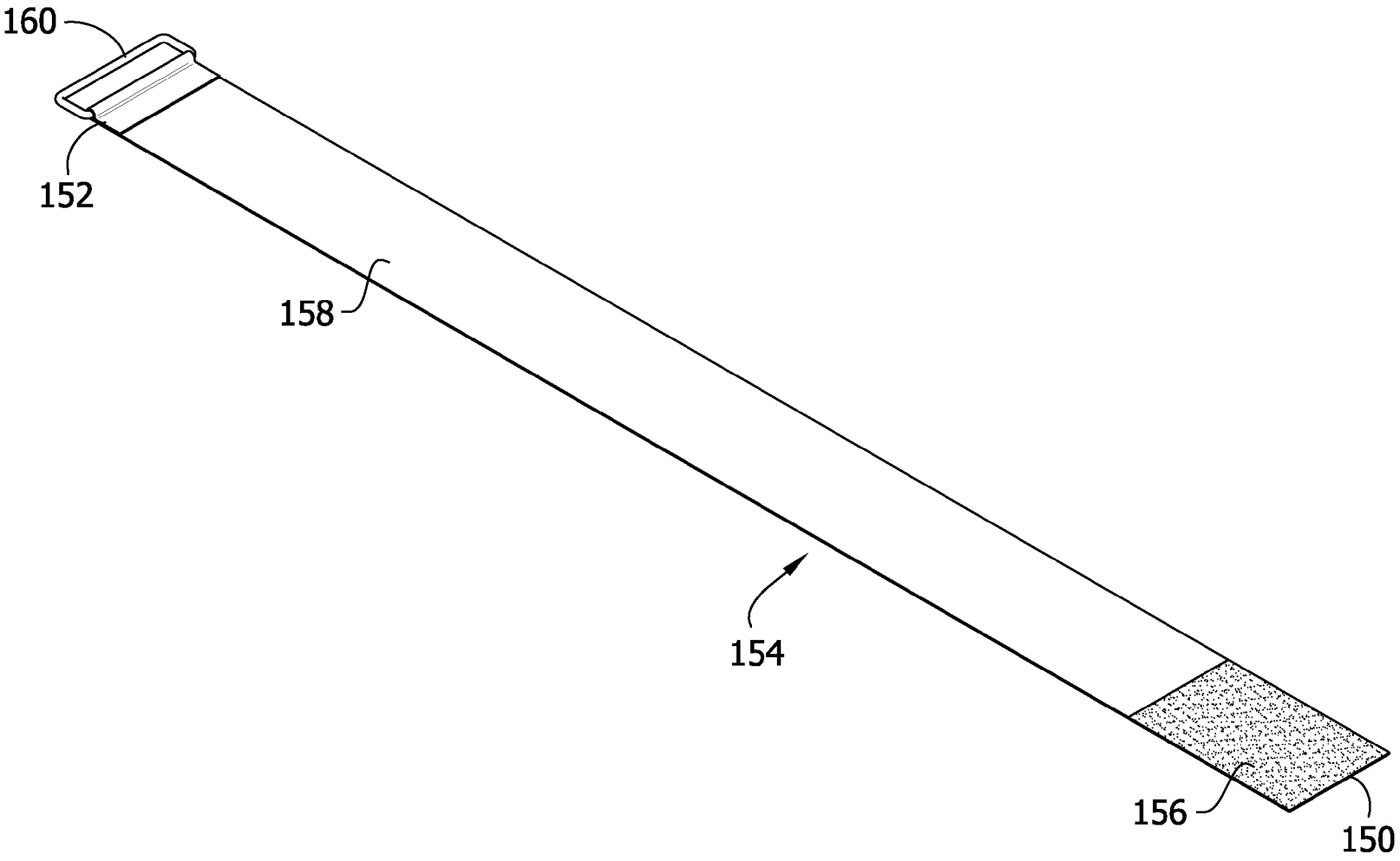
FIG. 3 is a perspective of a band of a holder of the sling.

Referring to FIG. 3, the holder bands 114 comprise elongate strips of pliable fabric sized for extending around portions of the medicine ball 100. In the illustrated embodiment, each of the four bands 114 is substantially identical. But it will be understood that the holder bands may be constructed differently from one another without departing from the scope of the invention. Each band 114 extends lengthwise between a first, free end 150 and a second, looped end 152. The second end 152 of the band 114 is attached to a rigid adjustment loop member 160. Each band 114 has a width that is sized to be received through a respective one of the perimeter slots 136. A fastening surface 154 of each band 114 includes a hook surface portion 156 and a loop surface portion 158 that form a complementary hook and loop fastener for fastening the band to itself and thereby securing the band to the adjustment plates 116, 117. The hook portion 156 of the fastening surface 154 extends from the free end 150 of the band 114 along a relatively short portion of the length of the band to an inner end of the loop portion 158. The loop portion 158 of the fastening surface 158 extends from adjacent the looped end 152 along a majority of the length of the band 114. The inner end of the loop portion 158 is positioned in side-by-side engagement with the inner end of the hook portion 156. The hook and loop surfaces 156, 158 function as a clasp for joining portions of the band to fasten the band 114 to the adjustment plates 116, 117. The bands 114 are also adjustable to adjust the size of the holder 112. By adjusting the position of the hook portion 156 relative to the loop portion 158, the user may adjust the length of the band 114 between the two plates 116, 117. It will be understood that other types of adjustable clasps may be used for fastening the bands to the plates without departing from the scope of the invention.

Figure 4:
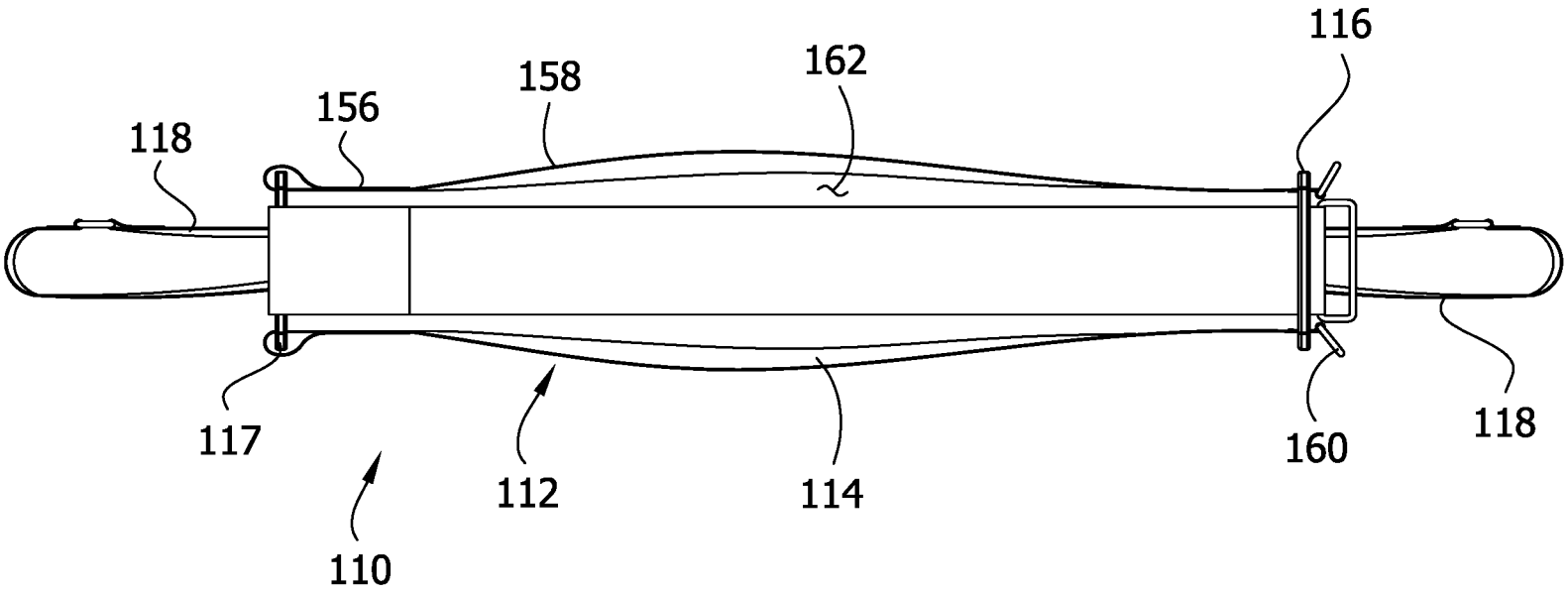
FIG. 4 is a perspective of the sling with the holder in a maximum size configuration.
Figure 5:
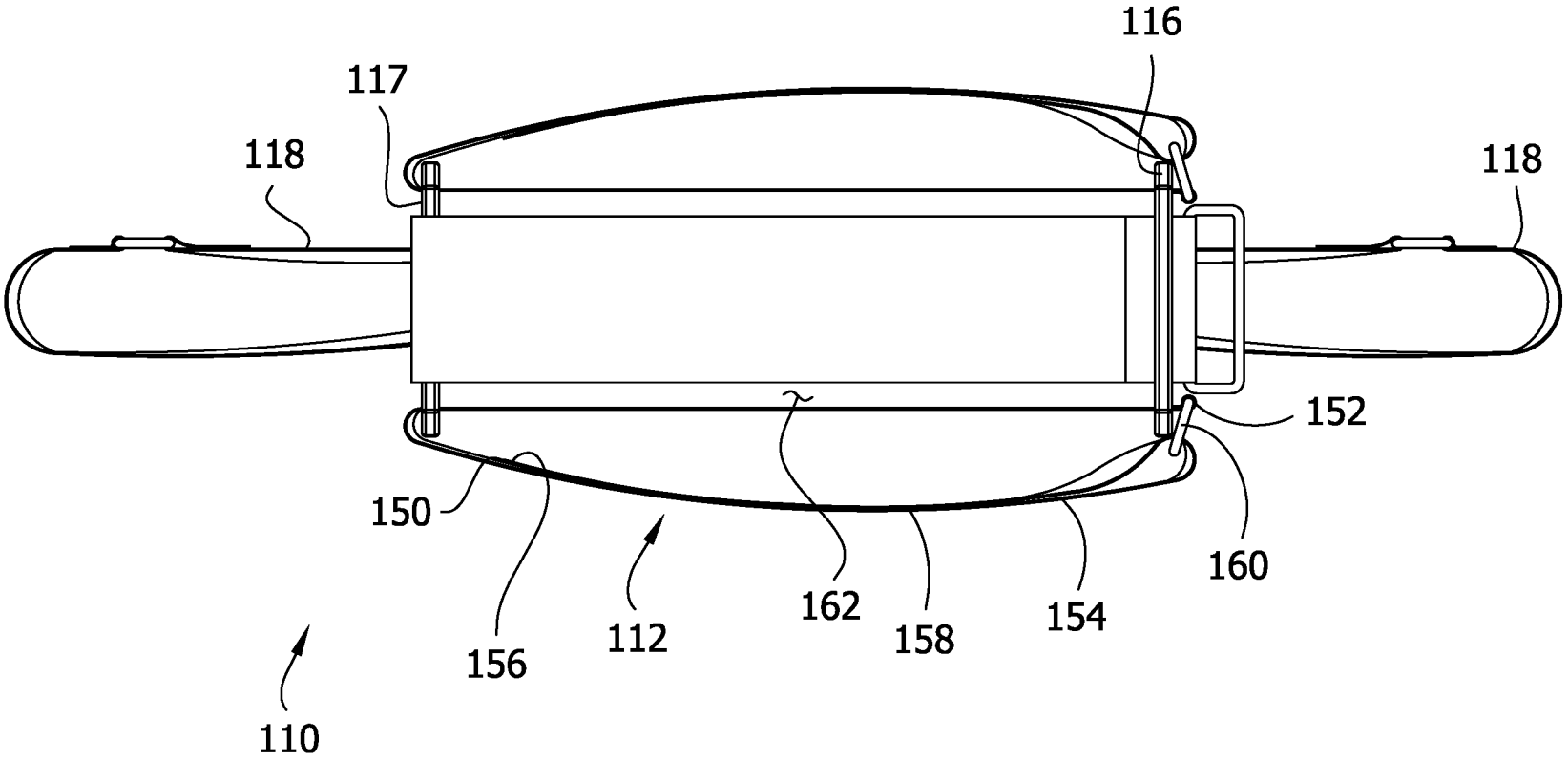
FIG. 5 is a perspective of the sling with the holder in a minimum size configuration.

Referring to FIGS. 4-5, the four bands 114 of the holder 112 are connected between the two plates 116, 117 to define an interior 162 for receiving a medicine ball 100. Each band 114 extends from a corresponding one of the perimeter slots 136 in the first plate 116 through a corresponding one of the perimeter slots in the second plate 117 and fastens to itself to form the holder 112. Although the illustrated holder 112 uses four bands 114 to secure the medicine ball 100 to the sling 110, it will be understood that other holders may use other numbers of bands (e.g., two or more, three or more, etc.) without departing from the scope of the invention. The free end 150 of each of the bands 114 extends through a respective one of the perimeter slots 136 in the first plate 116 such that the fastening surface 152 faces outward away from the interior 162. The loop member 160 engages the outer surface 132 of the first plate 116 to prevent the looped end 152 of the band 114 from passing through the slot 136. The free end 150 of each of the bands 114 extends further through a perimeter slot 136 in the second plate 117. An end portion of the band 114 adjacent the free end 150 loops around the outer surface 132 and adjacent side 134 of the second plate 117 so that the hook portion 156 faces inward toward the interior 162 and opposes the loop portion 158. By pulling the free ends 150 of the band 114 toward the looped end 152, the length of the band positioned between the two plates 116 can be shortened. When the hook portion 156 is pressed against the loop portion 158, the hook and loop fastener fixes the length of the band 114 between the two plates 116, 117. With a medicine ball 100 received in the interior 162, the length of the bands 114 extending between the first and second plates 116, 117 is shortened until the inner surfaces 130 of the plates and the inner surfaces of the bands firmly engage the medicine ball. When the medicine ball 100 is properly secured in the holder 112, the hook and loop fastener fastens the bands 114 in position.

The length of the bands 114 extending between the first and second plates 116, 117 can be adjusted to secure medicine balls 100 of a variety of predetermined sizes within the holder 112. As shown in FIG. 4, the holder 112 is adjustable to a maximum size configuration when only a small portion of each band 114 near the free end 150 loops around the second plate 117. In the configuration illustrated in FIG. 4, only the portion of the band 114 corresponding with the hook portion 156 of the fastening surface loops around the plate 117 before engaging the loop portion 158 to fasten the holder 112. In one or more embodiments, the holder 112 is configured to hold a medicine ball 100 having a diameter of from about 13 inches to about 14 inches when the holder is fastened in the maximum size configuration.

As shown in FIG. 5 the holder 112 is also adjustable to a minimum size configuration. In the minimum size configuration the free end 150 of each band 114 loops around the respective side 134 of the second plate 116 and extends back along the length of the band. The free end 150 of the band 114 then hooks around the adjustment loop member 160 so that the hook portion 156 of the fastener surface 154 faces outward, opposing a segment of the loop portion relatively near the free end. The free end 150 of each band 114 extends back toward the second plate 117 to a position in which the free end is adjacent the respective side 134 of the plate. To fasten each band 114 and thereby secure the holder 112 in the minimum size configuration, the outwardly facing hook portion 156 of the fastener surface 154 is pressed against the inwardly facing loop portion 158 near the second adjustment plate 117. In one or more embodiments, the holder 112 is configured to hold a medicine ball 100 having a diameter of from about 6 inches to about 7 inches when the holder is fastened in the minimum size configuration.

In the illustrated embodiment, the holder 112 is adjustable to hold medicine balls 100 having diameters of from about 6 inches (e.g., when fastened in the minimum size configuration) to about 14 inches (e.g., when fastened in the maximum size configuration). Other holders may be adjustable to hold medicine balls of other sizes without departing from the scope of the invention.

Figure 6:
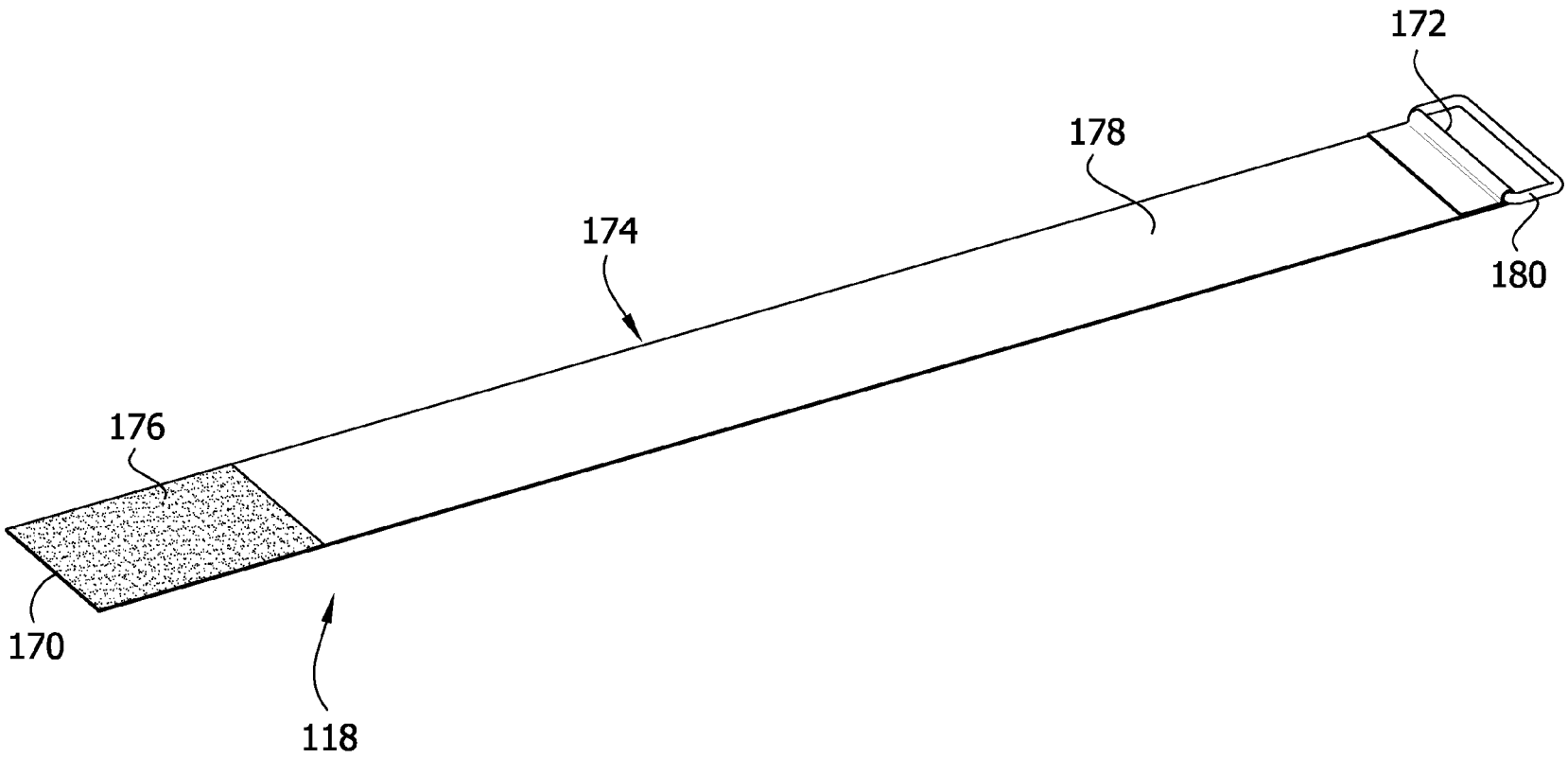
FIG. 6 is a perspective of a strap of the sling.

Referring to FIG. 6, the straps 118, like the bands 114, comprise elongate strips of pliable fabric. In the illustrated embodiment, the two straps 118 are substantially identical. But it will be understood that the straps may be constructed differently from one another without departing from the scope of the invention. Each strap extends lengthwise between a first, free end 170 and a second, looped end 172. The second end 172 of the strap 118 is attached to a rigid adjustment loop member 180. Each strap 118 has a width that is sized to be received through a respective one of the central slots 138. A fastening surface 174 of each strap 118 includes a hook surface portion 176 and a loop surface portion 178 that form a complementary hook and loop fastener for fastening the strap to one of the adjustment plates 116, 117 and for fastening the strap to form a loop. The hook portion 176 of the fastening surface 174 extends from the free end 170 of the strap 118 along a relatively short portion of the length of the strap to an inner end of the hook portion. The loop portion 178 of the fastening surface 174 extends from adjacent the looped end 172 of the strap 118 along a majority of the length of the strap. The inner end of the loop portion 178 is positioned in side-by-side engagement with the inner end of the hook portion 176. As will be discussed in further detail below, the hook and loop fastener may be used to selectively adjust the size of a loop for receiving a body portion P and securing the body portion to the sling 110. It will be understood that other types of adjustable fasteners may be used for fastening the straps to the plates and adjusting the size of the body portion-receiving loops without departing from the scope of the invention.

Figure 7:
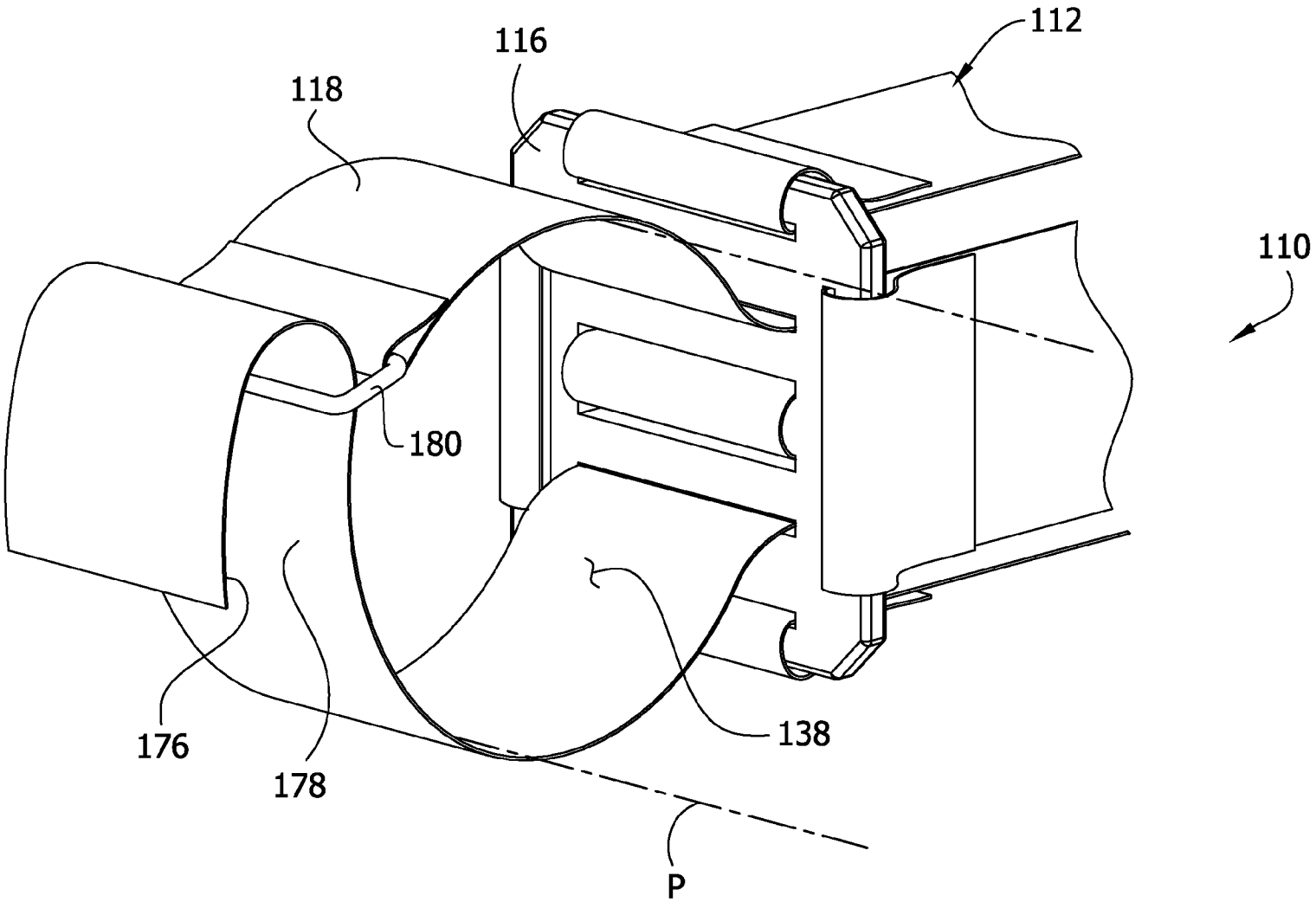
FIG. 7 is a fragmentary perspective of the sling with a body portion extending through the strap.

Reference will now be made to the attachment of one of the straps 118 to the first adjustment plate 116, with the understanding that the other strap attaches to the second adjustment plate 117 in the same way. Referring to FIG. 7, each adjustable strap 118 extends through the central slots 138 and fastens to itself to form an adjustable loop for receiving a portion P of a user's body. In the illustrated embodiment, the strap 118 extends through each of the four central slots 134, looping under the inner side 130 of the plate 116 and over the outer side 132 of the plate and in alternating sequence so that an end segment of the strap adjacent each end 170, 172 extends outward from the plate. Because the strap 118 loops under and over the plate 116 through all four central slots 134, there is a large amount of frictional engagement between the strap and plate, which inhibits the strap from sliding lengthwise through the slots when the sling 110 is in use. It will be understood that the strap 118 can extend through fewer than four central slots (e.g., two or more) without departing from the scope of the invention. Moreover, the strap 118 may also be secured to the plate 116 without passing through any slots without departing from scope of the invention.

The strap 118 is configured to fasten to itself to form a loop for receiving a portion P of a user's body. The free end 170 of the strap 118 hooks around the adjustment loop member 180 so that the hook portion 176 of the fastening surface 180 faces the loop portion 178. To secure strap 118 in a looped configuration, the hook portion 176 is pressed against the looped portion 178 to form a hook and loop connection. By pulling more or less of the length of the strap 118 through the adjustment loop member 180 before fastening the strap to itself, the size of the loop can be adjusted. To secure the strap 118 to the body portion P, the body portion is positioned in the loop and the free end 170 of the strap is pulled through the adjustment loop member 160 until the strap and adjustment plate 116 firmly engage the body portion. When the strap 118 firmly engages the body portion P, the hook portion 176 is pressed against the loop portion 178 to fasten the strap to the body portion. Preferably, the strap is adjustable to be fastened to many different portions P of a user's body (e.g., a foot, an ankle, a calf, a thigh, a hand, a wrist, a forearm, an upper arm, etc.). For example, in some embodiments the strap 118 is adjustable to secure body portions P having an effective diameter of between about 3 inches to about 5 inches to the sling 110.

In use, the bands 114 are adjusted to secure medicine balls 110 of different sizes in the interior 162 of the holder 112, and the straps 118 are adjusted to secure different body portions P to the sling 110. With the bands 114 holding the medicine ball 110 in the holder 112 and the straps attached to the desired body portions P, the sling 110 secures the medicine ball 110 to the user at the body portions. The user may perform exercises with the body portions P, and the weight of the medicine ball will enhance the effectiveness of the exercises. In one example, the straps 118 loop around a user's feet to secure the medicine ball between the user's legs. With the user laying face-up with legs outstretched, the user lifts his or her feet off the ground. The sling 110 secures the medicine ball 100 to the user's feet so that the user must lift the weight of the medicine ball to lift his or her feet off the ground. This type of exercise is an effective method of strengthening a user's abdominal and oblique muscles. The sling 110 also facilitates many other types of exercises with the medicine ball 100.

Thus, it can be seen that, in one or more embodiments, the sling 110 comprises first and second opposing plates 116, 117. Each of the first and second plates 116, 117 comprises four parallel strap slots 138 through which one of the adjustable straps 118 is looped to secure the straps to the plates. The first plate 116 and the second plate each comprises four peripheral slots 136 located around the periphery of the plates. Each of the four bands 114 extends through a peripheral slot on the first plate 116 and through a peripheral slot on the second plate 117 to connect the plates in face-to-face relationship separated by the holder interior 162 such that the four bands and two plates define the apparatus interior for holding the medicine ball 100. Each of the two adjustable straps 118 forms a loop extending away from the plates 116, 117 in a direction away from the interior 162 and opposite to a direction in which the bands 114 extend such that there is a first loop defined by an adjustable strap extending out from the first plate at one end of the sling 110, a second loop defined by the second adjustable strap extending out from the second plate at another end of the sling, and the four bands defining the interior situated between the two plates. In certain configurations, each of the four bands 114 comprises a loop of adjustable length that loops through the plates 116, 117 and attaches to itself such that each end of the bands has double thickness along its entire length between the two plates.

Having described the invention in detail, it will be apparent that modifications and variations are possible without departing from the scope of the invention defined in the appended claims.

When introducing elements of the present invention or the preferred embodiment(s) thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. An apparatus for use in combination with a medicine ball having a predetermined size, said apparatus comprising:

two opposing plates;

a plurality of at least four bands extending between said plates forming an interior for holding the medicine ball;

two adjustable straps, each strap extending from one of said opposing plates in a direction away from said interior for receiving a portion of a user's body during exercise; wherein the two opposing plates are a first plate and a second plate which each comprises four parallel strap slots through which one of the adjustable straps is looped to secure the straps to the plates;

the first plate and the second plate each comprises four peripheral slots located around the periphery of the plates;

each the four bands extends through a peripheral slot on the first plate and through a peripheral slot on the second plate to connect the plates in face-to-face relationship separated by said interior for holding the medicine ball, such that the four bands and two plates define the apparatus interior for holding the medicine ball;

each of the two adjustable straps forms a loop extending away from the plates away in a direction away from the interior and opposite to a direction in which the bands extend, such that that there is a first loop defined by an adjustable strap extending out from the first plate at one end of the apparatus, a second loop defined by a second adjustable strap extending out from the second plate at another end of the apparatus, and the four bands defining the apparatus interior situated between the two plates.

2. The apparatus as set forth in claim 1 wherein the plurality of at least four bands is exactly four bands and each of the four bands comprises a loop of adjustable length which loops through the plates and attaches to itself such that each of the bands has double thickness along its entire length between the two plates and the interior is defined by four double thickness bands.

3. The apparatus as set forth in claim 2 wherein each of the first plate and second plate is substantially square-shaped.

4. The apparatus as set forth in claim 3 wherein the four peripheral slots located around the periphery of each of the plates are located such that each of the slots are parallel to a side of the substantially square-shaped plates.

5. The apparatus as set forth in claim 2 wherein the two opposing plates are rigid.

6. The apparatus as set forth in claim 5 wherein the two opposing plates comprise a rigid plastic material.

7. The apparatus as set forth in claim 1 wherein each of the first plate and second plate is substantially square-shaped.

8. The apparatus as set forth in claim 7 wherein the four peripheral slots located around the periphery of each of the plates are located such that each of the slots are parallel to a side of the substantially square-shaped plates.

9. The apparatus as set forth in claim 1 wherein the two opposing plates are rigid.

10. The apparatus as set forth in claim 9 wherein the two opposing plates comprise a rigid plastic material.

11. The apparatus as set forth in claim 1 wherein each of the plurality of at least four bands comprises a loop of adjustable length which loops through the plates and attaches to itself such that each of the bands has double thickness along its entire length between the two plates.

12. The apparatus as set forth in claim 1 wherein the plurality of at least four bands is exactly four bands.

* * * * *